US010367311B2

(12) United States Patent
Zebhauser et al.

(10) Patent No.: US 10,367,311 B2
(45) Date of Patent: Jul. 30, 2019

(54) PLUG CONNECTOR ARRANGEMENT WITH COMPENSATION CRIMP

(71) Applicant: ROSENBERGER HOCHFREQUENZTECHNIK GMBH & CO. KG, Fridolfing (DE)

(72) Inventors: Martin Zebhauser, Laufen (DE); Gunnar Armbrecht, Mühldorf am Inn (DE); Stephan Kunz, Chieming (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/547,087

(22) PCT Filed: Jan. 26, 2016

(86) PCT No.: PCT/EP2016/000132

§ 371 (c)(1),
(2) Date: Jul. 28, 2017

(87) PCT Pub. No.: WO2016/120012

PCT Pub. Date: Aug. 4, 2016

(65) Prior Publication Data

US 2018/0013241 A1 Jan. 11, 2018

(30) Foreign Application Priority Data

Jan. 30, 2015 (DE) ..... 20 2015 000 751 U

(51) Int. Cl.
*H01R 4/20* (2006.01)
*H01R 13/6592* (2011.01)
(Continued)

(52) U.S. Cl.
CPC ..... *H01R 13/6592* (2013.01); *H01R 4/183* (2013.01); *H01R 4/20* (2013.01);
(Continued)

(58) Field of Classification Search
CPC ..... H01R 2103/00; H01R 9/0518; H01R 9/0524; H01R 13/622; H01R 24/40;
(Continued)

(56) References Cited

U.S. PATENT DOCUMENTS 2,279,794 A * 4/1942 Olson ..... H01R 4/203 29/882
2,769,965 A * 11/1956 Frey ..... H01R 4/20 439/730

(Continued)

FOREIGN PATENT DOCUMENTS

CN 1851987 A 10/2006
CN 102780097 A 11/2012

(Continued)

*Primary Examiner* — Truc T Nguyen
(74) *Attorney, Agent, or Firm* — DeLio, Peterson & Curcio, LLC; Robert Curcio

(57) ABSTRACT

A plug arrangement having a plug and a cable that is connected thereto and includes at least one inner conductor and an outer conductor surrounding the inner conductor(s); an axial terminal section of the outer conductor is electrically connected to a sleeve portion of an outer conductor housing of the plug, said sleeve portion surrounding the outer conductor; a crimp point comprising a radial constriction of the sleeve portion is located between the axial terminal section of the outer conductor and the axial end of the inner conductor in the longitudinal direction (L) of the cable.

19 Claims, 4 Drawing Sheets

(51) Int. Cl.
*H01R 9/05* (2006.01)
*H01R 9/03* (2006.01)
*H01R 4/18* (2006.01)
*H01R 13/6474* (2011.01)

(52) U.S. Cl.
CPC ..... *H01R 9/034* (2013.01); *H01R 9/0518* (2013.01); *H01R 13/6474* (2013.01)

(58) Field of Classification Search
CPC .... H01R 9/05; H01R 13/5205; H01R 9/0521; H01R 24/38; H01R 43/26; H01R 13/6592; H01R 13/6593; H01R 9/0527; H01R 13/523
See application file for complete search history.

(56) References Cited

U.S. PATENT DOCUMENTS 2,970,184 A 1/1961 Blonder
3,295,094 A 12/1966 De Lyon
4,010,538 A * 3/1977 O'Keefe ..... H01R 9/0518 29/865
4,269,469 A * 5/1981 Audic ..... H01R 9/0518 439/424
5,123,864 A * 6/1992 Karlovich ..... H01R 4/184 439/585
5,207,596 A * 5/1993 Tran ..... H01R 9/0518 439/585
5,480,325 A 1/1996 Tran et al.
6,107,572 A * 8/2000 Miyazaki ..... H01R 9/0518 174/75 C
6,217,381 B1 * 4/2001 Kameyama ..... H01R 9/0518 439/578
7,291,043 B2 11/2007 Morikawa
9,865,942 B2 * 1/2018 Hamada ..... H01R 4/20
2004/0118590 A1 * 6/2004 Head ..... E21B 17/028 174/105 R
2010/0297877 A1 * 11/2010 Nakamura ..... H01R 9/0518 439/585
2012/0285715 A1 * 11/2012 Mayer ..... H01R 9/032 174/34
2013/0029523 A1 * 1/2013 Poma ..... H01R 4/20 439/585
2014/0000954 A1 * 1/2014 Furukawa ..... H01R 4/188 174/359
2014/0374155 A1 * 12/2014 Tachibana ..... H01R 4/62 174/84 C
2015/0207265 A1 * 7/2015 Plant ..... H01R 13/523 439/271
2016/0035462 A1 * 2/2016 Friesinger ..... H01B 11/1895 174/70 R
2017/0215307 A1 * 7/2017 Morgan ..... H01R 9/0518
2018/0013214 A1 * 1/2018 Zebhauser ..... H01R 9/0518
2018/0083404 A1 * 3/2018 Hofling ..... H01R 43/05
2018/0151996 A1 * 5/2018 Matsumoto ..... H01R 4/027
2018/0175518 A1 * 6/2018 Mori ..... H01R 9/0518

FOREIGN PATENT DOCUMENTS

DE 3427361 C1 9/1985
DE 29515027 U1 9/1995
JP 2001155822 A 6/2001
JP 3606436 B2 1/2005
TW 542456 U 7/2003

* cited by examiner

PLUG CONNECTOR ARRANGEMENT WITH COMPENSATION CRIMP

BACKGROUND OF THE INVENTION

1. Field of the Invention

The invention relates to a plug connector arrangement consisting of a plug connector and a cable connected thereto. The cable has at least one inner conductor and an outer conductor surrounding the inner conductor, wherein an axial end section of the outer conductor is connected electrically with a sleeve section of an outer conductor housing of the plug connector surrounding this.

The plug connector has a plug-side end for connecting the plug connector with a mating plug connector and a cable-side end to which the cable is attached (preferably inseparably through soldering or crimping). The inner conductor of the cable is thereby connected electrically with an inner conductor part of the plug connector such as a contact pin or a socket and the outer conductor of the cable is connected electrically with the outer conductor housing of the plug connector surrounding the inner conductor part, so that a continuous shielding is preferably formed from the cable up to the plug-side end of the plug connector.

2. Description of Related Art

In order to create the connection between the plug connector and the cable, it is known for the sleeve section of the outer conductor housing, consisting of an electrically conductive material and surrounding the end section of the outer conductor, to be crimped or pressed together with the axial end section of the outer conductor. For this purpose, during manufacture of the plug connector arrangement the cable is stripped at its front end, i.e., sections of the cable sheath are removed, so that the outer conductor is exposed. The sleeve section of the outer conductor housing is then pressed together with the exposed outer conductor.

However, it has been found that a plug connector arrangement manufactured in the conventional manner described above is often not optimally electrically matched in the region of the connection between the plug connector and the cable. In particular, undesirable deviations from the intended characteristic impedance, for example an undesirable increase in impedance, can occur in the connection region.

SUMMARY OF THE INVENTION

In view of the problems described, it is the object of the present invention to provide a stable connection, with high tensile strength, between the plug connector and the cable which is also optimally electrically matched, preferably over its entire extension in the longitudinal direction of the cable.

This problem is solved through a plug connector arrangement according to the independent claims. Advantageous further developments of the invention are described in the dependent claims.

The above and other objects, which will be apparent to those skilled in the art, are achieved in the present invention which is directed to a plug connector arrangement comprising a plug connector and a cable connected thereto with at least one inner conductor and an outer conductor surrounding the inner conductor, wherein an axial end section of the outer conductor is connected electrically with a sleeve section of an outer conductor housing of the plug connector surrounding this, the plug connector arrangement including a crimp point with a radial constriction of the sleeve section which is arranged, in the longitudinal direction of the cable (L), between the axial end section of the outer conductor and the axial end of the inner conductor, wherein the depth of the radial constriction is such that the inner diameter of the sleeve section at the crimp point substantially corresponds to the diameter of the outer conductor of the cable, wherein the crimp point has a non-rotationally symmetrical crimp.

The crimp point is arranged directly adjacent to the axial end section of the outer conductor, wherein the distance between the crimp point and the axial end section is approximately less than 2 mm, or approximately less than 0.5 mm, or approximately 0 mm.

The plug-connector-side end of the crimp point is arranged directly adjacent to a main body of the outer conductor housing which has approximately the same inner diameter as the outer conductor of the cable, wherein the distance between the crimp point and the main body is approximately less than 3 mm.

The crimp point may be a flat crimp with flat pressing surfaces.

The crimp may have three or more flat pressing surfaces surrounding the inner conductor which each have substantially the same dimension in the circumferential direction, wherein the sleeve section preferably has, in cross section, a substantially square outer contour at the crimp point.

There may be at least one further crimp point on the side of the crimp point facing away from the plug connector at which the outer conductor of the cable is pressed together with the sleeve section of the plug connector.

The outer diameter of the sleeve section at the crimp point is less than at the further crimp point.

The plug connector arrangement may include a supporting sleeve surrounding the inner conductor on the side of the crimp point facing away from the plug connector.

The supporting sleeve may be arranged radially on the outside of the outer conductor, and wherein the outer conductor is folded back over the supporting sleeve.

The outer conductor may be in the form of a braid, or a conductive foil, and/or the inner conductor is in the form of a core surrounded by a dielectric or of one or more insulated wires.

The cable is preferably a coaxial cable, a shielded twisted-pair cable, a shielded star quad cable, or similar.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
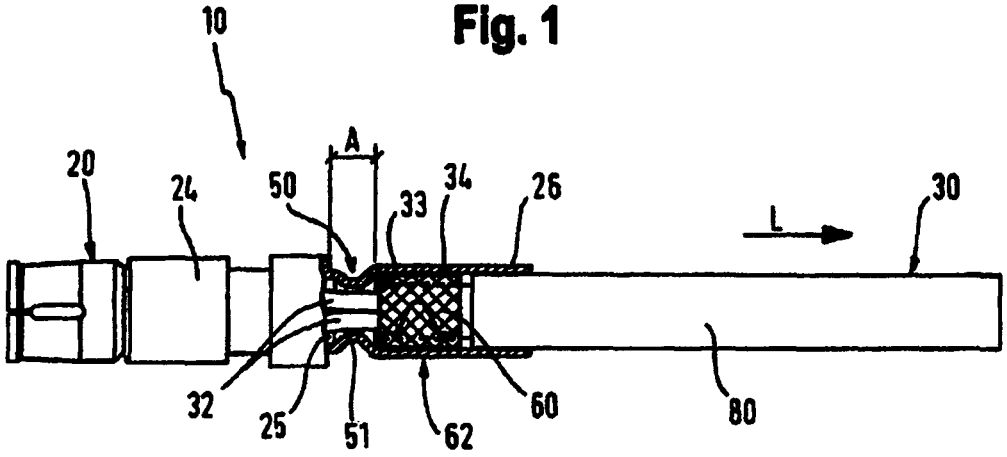
FIG. 1 shows a schematic side view of a plug connector arrangement according to the invention, shown in part in the form of a longitudinal section.

In describing the preferred embodiment of the present invention, reference will be made herein to FIGS. 1-5 of the drawings in which like numerals refer to like features of the invention.

The plug connector arrangement according to the invention has a crimp point with a radial constriction of the sleeve section which is arranged, in the longitudinal direction of the cable, between the axial end section of the outer conductor and the axial end of the inner conductor. Preferably, the crimp point is created through a pressing force acting radially from the outside on the sleeve section of the outer conductor housing in the region between the front axial end of the outer conductor and the plug-side end of the sleeve section. This pressing force is preferably applied from all sides, so that the radial constriction of the sleeve section completely surrounds the inner conductor. As a result, the radial distance between the sleeve section and the inner conductor is less in the region of the radial constriction than in the rest of the sleeve section which is not radially constricted.

The invention is based on the knowledge that, in order to achieve a constant impedance in the longitudinal direction of the cable with unchanged cable geometry and the same dielectrics, a substantially constant distance between the inner conductor and the outer conductor of the cable is necessary. Thus, an increase in the distance between the inner conductor and outer conductor of the cable generally leads to an inductive region or to an undesirable increase in impedance. In conventional plug connector arrangements, an undesirable abrupt change in the distance between the inner conductor and the outer conductor (or the shielding of the inner conductor) generally occurs at the front axial end of the outer conductor. In contrast, according to the invention, the radial constriction of the sleeve section in that region of the cable at its front end in which no outer conductor of the cable surrounds the inner conductor means that the extent of this abrupt change in the distance between inner conductor and shielding is reduced, since as a result of the pressing force the sleeve section, consisting of a conductive material, is brought closer to the inner conductor, so that the constricted sleeve section of the outer conductor of the cable continues beyond the end of the actual outer conductor in the direction of the plug connector.

Advantageously, the crimp point is arranged directly on the axial end section or adjacent to the front axial end of the outer conductor, wherein the distance between the crimp point and the axial end section is preferably less than 2 mm, in particular less than 0.5 mm. In other words, the constriction of the sleeve section is arranged directly adjacent to the axial end of the outer conductor in order to reliably avoid a local change in impedance in this region.

Furthermore, the depth of the radial constriction is preferably such that the inner diameter of the sleeve section at the crimp point substantially corresponds to that of the outer conductor of the cable, so that the constricted sleeve section of the outer conductor housing effectively continues the outer conductor in the direction of the front cable end at a constant distance from the inner conductor.

Preferably, the ratio between the inner diameter of the sleeve section at the deepest point of the constriction and the inner diameter of the outer conductor is between 0.9 and 1.2. particularly preferably between 0.95 and 1.1, in particular between 0.98 and 1.05, so that at its axial front end the outer conductor transitions practically seamlessly into the sleeve section. In this way, an abrupt change in the distance between the inner conductor and its shielding at the front end of the outer conductor is reliably prevented.

Alternatively or additionally, the plug-connector-side end of the crimp point is arranged directly adjacent to a main body of the outer conductor housing, starting out from which the sleeve section projects in the longitudinal direction of the cable, and which has roughly the same diameter as the outer conductor of the cable, wherein the distance between the crimp point and the main body is preferably less than 3 mm, in particular less than 1 mm.

Since the outer conductor of the cable generally lies on a dielectric surrounding the inner conductor and thus has a significantly smaller diameter than the sleeve section of the outer conductor housing, a particularly high radial crimp force is generally necessary in order to produce the radial constriction in the necessary depth. An (exactly) radially symmetrical crimp with such a depth can be problematic, since under certain circumstances this can lead to damage to the inner conductor or the sleeve section. For this reason it has proved expedient to provide a crimp point with a non-rotationally symmetrical crimp, in particular a non-rotationally symmetrical insulation crimp (the sleeve section is pressed together at the crimp point with the dielectric of the cable and not with the outer conductor of the cable). In a non-rotationally symmetrical crimp, radial forces are applied which vary locally in a circumferential direction, which overall leads to a greater maximum depth of the radial constriction. A flat crimp with pressing surfaces which are flat in a circumferential direction, in particular a star crimp has proved particularly advantageous.

In this connection it has proved particularly advantageous for the crimp to have three or more, in particular four pressing surfaces surrounding the inner conductor. In cross section, the sleeve section thus substantially has the outer contour of a polygon, in particular of a regular polygon, at the crimp point. On the one hand, flat pressing surfaces which substantially have the same dimension in a circumferential direction can be produced simply by means of a correspondingly formed (crimp) stamp, wherein a substantially even force in the circumferential direction is applied simultaneously to the sleeve section. A crimp point which is substantially square in cross section has proved particularly advantageous, in particular in the case of four inner conductors which can run in the form of a star quad arrangement.

In order to achieve an optimal electrical connection between the outer conductor and the outer conductor housing, it has proved expedient to provide at least one further crimp point on the side of the (first) crimp point facing away from the plug connector, wherein the outer conductor of the cable is pressed together with the sleeve section of the plug connector at the further crimp point. The further crimp point can be arranged at an axial distance from the first crimp point or alternatively can overlap this, at least partially, in an axial direction. The provision of more than one crimp point also leads to a particularly stable and high-tensile connection of plug connector and cable. An insulation crimp can be provided at the first crimp point and/or a conductor crimp can be provided at the second point.

In order to achieve a stable fixing of the front cable end in the sleeve section while at the same time maintaining a substantially constant radial distance between the inner conductor and its shielding it has proved advantageous if the outer diameter and/or the inner diameter of the outer conductor housing is less at the crimp point than at the further crimp point, since the cable does not have an outer conductor at the crimp point, so that a deeper radial constriction of the sleeve section is necessary here than at the further crimp point with an outer conductor. In other words, the radial constriction of the sleeve section is deeper at the crimp point than the further radial constriction of the sleeve section formed at the further crimp point.

The cable preferably has a supporting sleeve surrounding the inner conductor on the side of the first crimp point facing away from the plug connector. Preferably, the inner diameter of the supporting sleeve is somewhat larger than the outer diameter of the outer conductor, so that the supporting sleeve can be applied to the outside of the outer conductor without any problem. The supporting sleeve serves to improve the pressing together of the outer conductor and sleeve section, avoiding damage to the inner conductor during the crimping process.

While the further crimp point is positioned at the level of the supporting sleeve, the (first) crimp point is preferably arranged, in the longitudinal direction of the cable, between the plug-side end of the supporting sleeve and the plug-side end of the sleeve section.

The supporting sleeve can be provided in order to hold and fix in place the front end of the outer conductor, in particular if the outer conductor is in the form of a wire braid or similar. For this purpose, the supporting sleeve is preferably arranged radially on the outside of the outer conductor. In this connection it has proved advantageous if the plug-side end of the supporting sleeve, in the longitudinal direction of the cable, substantially coincides with the axial front end of the outer conductor, so that the supporting sleeve supports and holds the outer conductor as far as its front axial end.

In order to achieve an optimal electrical and mechanical connection between the outer conductor, the supporting sleeve and the outer conductor housing it has proved advantageous if the outer conductor is folded back over the supporting sleeve. In this case a particularly durable and stable crimped connection between the outer conductor, preferably in the form of a wire braid, and the supporting sleeve or the sleeve section of the outer conductor housing can be produced through pressing.

In a particularly preferred embodiment of the invention, the supporting sleeve is, at least in sections, designed in the form of a cylinder-barrel-formed sleeve, for example a crimp sleeve, which can either be formed as a single part or can consist of several cylindrical shell parts. The inner diameter of the supporting sleeve can be adapted to the outer diameter of the outer conductor.

In order to achieve an economical manufacture and in order to achieve a comparatively light cable weight it has proved advantageous if the outer conductor is in the form of a braid, for example a wire braid. A wire braid is also particularly suitable for manufacturing a pressed connection and is suitable for folding back over the supporting sleeve.

On the other hand, the inner conductor can be in the form of a core surrounded by a dielectric or of one or more insulated wires. For example, one or more inner conductor pairs are provided for the transmission of one or more differential signals via the cable. Two inner conductor pairs can for example run in a star quad arrangement. Preferably, all inner conductors are surrounded by the common outer conductor in the form of a wire braid.

The cable can be a coaxial cable, a shielded twisted-pair cable, a shielded star quad cable or similar. Such cables are generally intended for the transmission of HF signals, wherein in this case an optimal electrical matching is particularly important in order to avoid a distortion of the signal.

In the following description, the invention is explained with reference to the enclosed drawings.

The plug connector arrangement 10 according to the invention 10 shown schematically in FIG. 1 consists of an (only partially represented) plug connector 20, for example a coaxial plug, and a cable 30 connected thereto, for example a coaxial cable, a star quad cable or similar.

The plug connector 20 is designed for connection with a mating plug connector, for example a socket part, at its plug-side end, shown on the left in FIG. 1. The cable 30 is attached, in a manner resistant to tensile loads, to the cable-side end of the plug connector 20, shown on the right in FIG. 1.

The cable 30 has (in this case, by way of example) a total of four twisted inner conductors 32, each in the form of a wire provided with insulation. Two inner conductors 32 in each case form a differential conductor pair for the transmission of differential signals, for example HF signals or similar. The four inner conductors 32 are surrounded by a common (cable) outer conductor 34 in the form of a wire braid and/or a conductive foil which shields the inner conductor 32 from the outside. The wire braid lies against the outside of the insulation of the wires. The outer conductor 34 is surrounded, coaxially on the outside, by a cable sheath 80 made of a non-conductive material, for example a plastic.

The inner conductors 32 are in each case connected electrically, at their front end facing the plug connector 20, with inner conductor contacts (not shown) of the plug connector 20. The outer conductor 34 is connected electrically, at its front end facing the plug connector 20, with a sleeve section 26 of the outer conductor housing 24 of the plug connector 20, wherein the outer conductor housing 24 continues the shielding of the inner conductor 32 as far as the plug-side end of the plug connector 20.

The front cable end is accommodated in the tubular sleeve section 26 of the outer conductor housing 24 which, starting out from a main body of the outer conductor housing 24, projects on the cable side. The inner diameter of the sleeve section 26 corresponds substantially to the outer diameter of the cable sheath 80, so that the cable 30 can be inserted into the opening formed by the sleeve section 26.

The cable sheath 80 is removed at the front end of the cable 30, so that the outer conductor 34 of the cable is exposed and can be brought into in electrical contact with the wall of the sleeve section 26.

In order to improve the fixing of the front axial end 33 of the outer conductor of the cable 34 and in particular to prevent damage to the inner conductor 32 during manufacture of the further crimp point 62 between the outer conductor of the cable 34 and the sleeve section 26, a supporting sleeve 60 is provided on a front section of the outer conductor 34. The wire braid of the outer conductor 34 is folded back over the front end of the supporting sleeve 60 so that the wire braid of the outer conductor 34 lies against the supporting sleeve 60 on the inside and on the outside. The wire braid lying against the front end of the supporting sleeve 60 thus forms the front axial end 33 of the outer conductor 34.

As is clearly shown in FIG. 1, a space without any outer conductor of the cable is formed between the axial end 33 of the outer conductor of the cable 34 and the main body 25 of the plug connector in which a crimp point 50 with a radial constriction 51 of the sleeve section 26 is formed. Without the crimp point 50, the distance between the inner conductors 32 and the sleeve section 26 would be considerable in this space, which would lead to an insufficient electrical matching. The crimp point 50 is therefore designed such that, in the region of the radial constriction 51, the inner diameter of the sleeve section 26 substantially corresponds to the inner diameter of the outer conductor 34. This means that in the region of the crimp point 50 the radial distance between the inner conductors 32 and their shielding continues roughly constant in the direction of the plug-side end of the plug connector 20, which leads to an optimal electrical matching in this region.

As can be seen in FIG. 1, the distance between the radial constriction 51 and the front axial end 33 of the outer conductor of the cable is less than 1 mm, whereas the distance between the main body 25 of the outer conductor housing 24 and the constriction 51 is less than 2 mm. In the region of the main body 25, the inner diameter of the outer conductor housing 24 substantially corresponds to that of the outer conductor 34 of the cable 30. The axial dimension (A) of the constriction 51 is greater than 50%, particularly preferably greater than 80%, in particular around 100% of the axial distance between the main body 25 of the plug connector and the front axial end 33 of the outer conductor of the cable 34. FIG. 1 also shows that the outer diameter of the sleeve section 26 at the crimp point 50 is less than at the further crimp point 62 at which the outer conductor 34 is pressed together with the sleeve section 26 or with the supporting sleeve 60.

Figure 2:
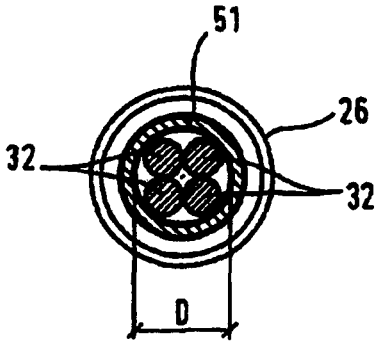
FIG. 2 shows a schematic sectional view of the plug connector arrangement from FIG. 1, viewed from the left.

The crimp at the crimp point 50 shown in FIG. 1 is a conventional, substantially rotationally symmetrical crimp. FIG. 2, which is represented in part as a cross sectional view, shows that the inner diameter (D) of the sleeve section 26 in the region of the radial constriction 51 amounts to around 60% of the inner diameter of the sleeve section 26 at its cable-side end or in the unpressed state. It can also be seen that the crimp depth is chosen such that the wall of the sleeve section 26 at the crimp point 50 lies against the outside of the insulation of the four inner conductors 32, as in the remainder of the cable of the outer conductor 34.

Figure 6:
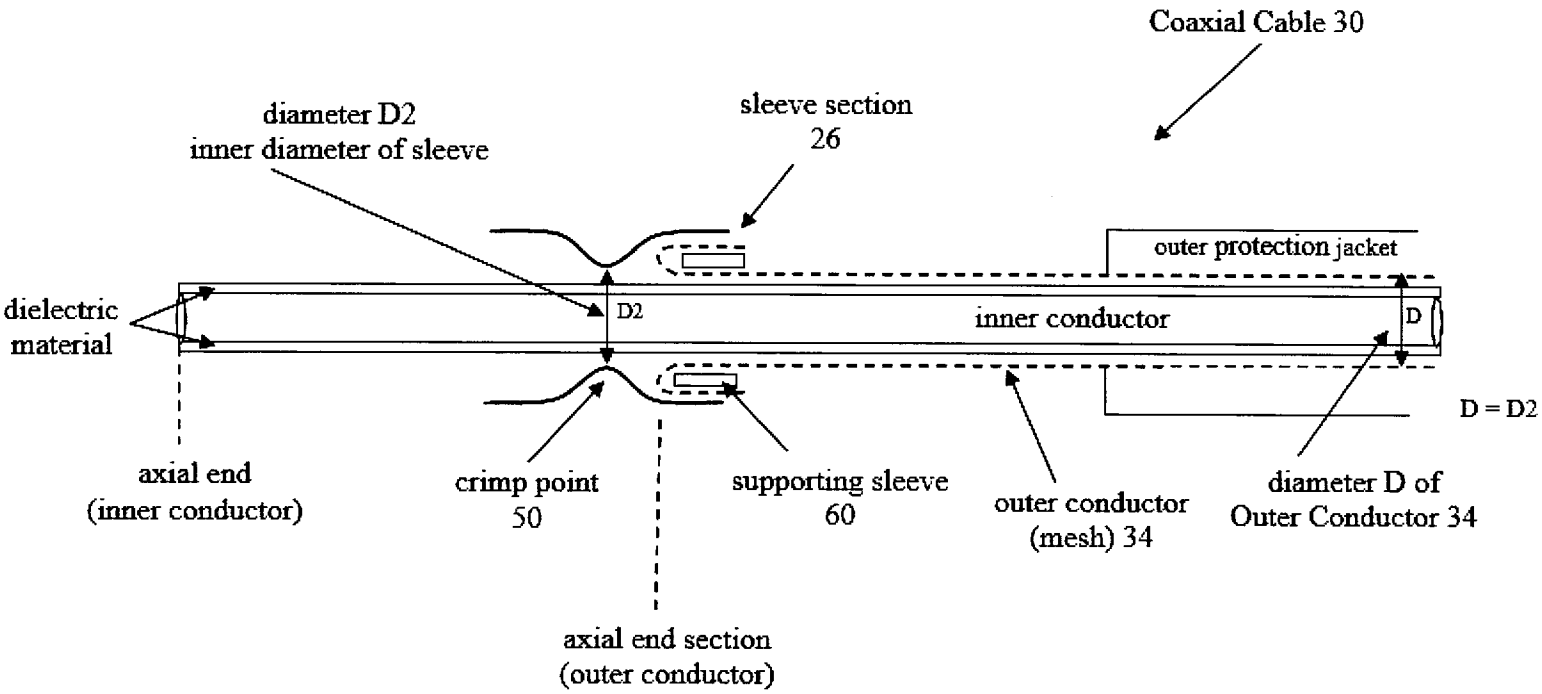
Fig.6 is a line drawing depicting the relationship of the elements of Fig.1.

Fig.6 is a line drawing depicting the relationship of the elements of Fig.1 as discussed above.

Figure 3:
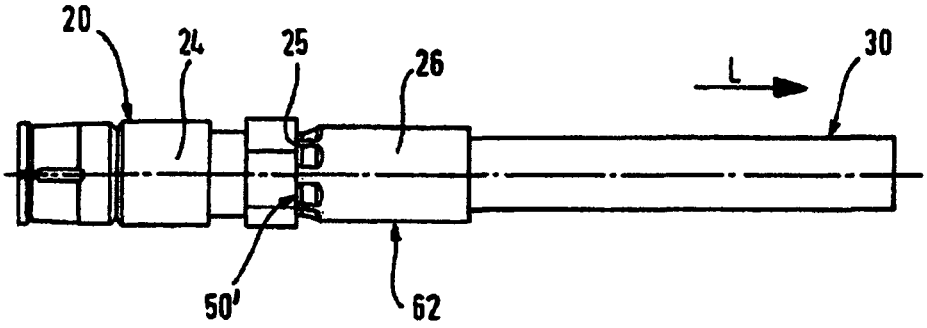
FIG. 3 shows a side view of a second embodiment of a plug connector arrangement according to the invention.
Figure 4:
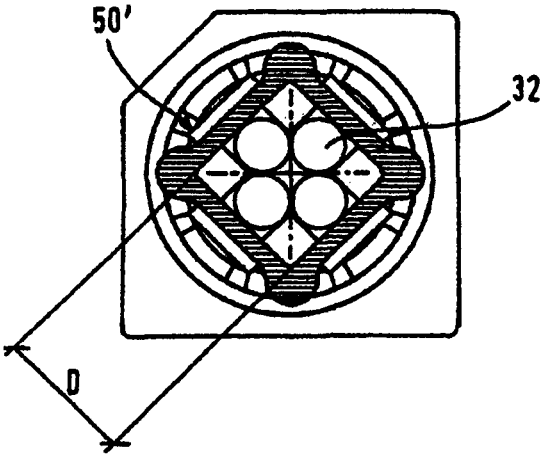
FIG. 4 shows a sectional view of the second embodiment shown in FIG. 3 viewed from the right.

The second embodiment of a plug connector arrangement according to the invention shown in the FIGS. 3 and 4 substantially corresponds to the first embodiment, so that reference is made to the above remarks. The only significant difference involves the design of the crimp point 50'. Like the crimp point 50, the crimp point 50' is arranged between the axial front end 33 of the outer conductor of the cable 34 and a main body 25 of the outer conductor housing 24, starting out from which the sleeve section projects in the longitudinal direction of the cable. However, a star crimp is provided at the crimp point 50' which has several flat pressing surfaces, while at the further crimp point 62 a rotationally symmetrical crimp or, alternatively or additionally, also a flat crimp can be provided which however can be less deep than the star crimp at the crimp point 50'.

As shown in FIG. 4, the wall of the sleeve section 26 is substantially square in the region of the star crimp 50', wherein accumulations of material can be formed at the corners of the square through the pressing procedure. Such a crimp form has proved particularly advantageous, particularly in the case of an inner conductor with four wires in the manner of a star quad arrangement. Alternatively, a crimp contour in the form of a polygon with a greater number of equal sides can be used. A flat crimp, for example a star crimp, can be more protective of the material than a round crimp when producing deep constrictions, since overall lesser pressing forces need to be applied, since during crimping these initially act locally. The "inner diameter" D of the sleeve section 26 at the crimp point 50' (in this case the diameter of the inscribed circle of the square formed by the four crimp sides) corresponds to the diameter D of the sleeve section 26 at the crimp point 50 shown in FIG. 2.

Figure 5:
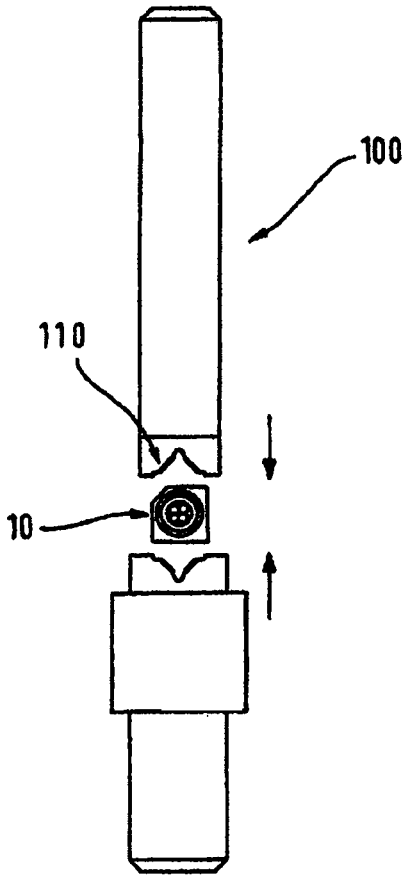
FIG. 5 shows a view of a crimping stamp for manufacturing the plug connector arrangement shown in FIGS. 3 and 4.

A stamp 100 for creating the crimp point 50' of the plug connector arrangement according to FIGS. 3 and 4 is shown schematically in a side view in FIG. 5. The plug connector arrangement 10 is laid in the correct position in the longitudinal direction of the cable L between an upper and a lower die of the stamp 100 and the upper and lower dies are then moved towards one another. In the pressing position, the pressing contours 110 of the upper and lower dies form a negative contour of the crimp form which is to be produced. As shown, the press contour 110 can include recesses provided to accommodate accumulations of material produced during the pressing process.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug connector arrangement comprising a plug connector and a cable connected thereto with at least one inner conductor and an outer conductor surrounding the inner conductor, wherein an axial end section of the outer conductor is connected electrically with a sleeve section of an outer conductor housing of the plug connector surrounding the axial end section of the outer conductor, said plug connector arrangement including a crimp point with a radial constriction of the sleeve section which is arranged, in a longitudinal direction of the cable between the axial end section of the outer conductor and an axial end of the inner conductor, wherein a depth of the radial constriction is such that an inner diameter of the sleeve section at the crimp point substantially corresponds to an outer diameter of the outer conductor of the cable, wherein the crimp point has a non-rotationally symmetrical crimp.

2. The plug connector arrangement of claim 1, wherein the crimp point is arranged directly adjacent to the axial end section of the outer conductor, wherein the distance between the crimp point and the axial end section of the outer conductor is approximately less than 2 mm.

3. The plug connector arrangement of claim 1, wherein a plug-connector-side end of the crimp point is arranged directly adjacent to a main body of the outer conductor housing which has approximately the same inner diameter as the outer conductor of the cable, wherein the distance between the crimp point and the main body is approximately less than 3 mm.

4. The plug connector arrangement of claim 1, wherein the crimp point has a flat crimp with flat pressing surfaces.

5. The plug connector arrangement of claim 1, including at least one further crimp point on the side of the crimp point facing away from the plug connector at which the outer conductor of the cable is pressed together with the sleeve section of the plug connector.

6. The plug connector arrangement of claim 1, wherein the outer conductor is in the form of a braid, or a conductive foil, and/or the inner conductor is in the form of a core surrounded by a dielectric or of one or more insulated wires.

7. The plug connector arrangement of claim 1, wherein the cable is a coaxial cable, a shielded twisted-pair cable, or a shielded star quad cable.

8. The plug connector arrangement of claim 1, wherein the crimp point is arranged directly adjacent to the axial end section of the outer conductor, wherein the distance between the crimp point and the axial end section is approximately less than 0.5 mm.

9. The plug connector arrangement of claim 1, wherein the plug-connector-side end of the crimp point is arranged directly adjacent to a main body of the outer conductor housing which has approximately the same inner diameter as the outer conductor of the cable, wherein the distance between the crimp point and the main body is approximately less than 1 mm.

10. The plug connector arrangement of claim 1, wherein the plug-connector-side end of the crimp point is arranged directly adjacent to a main body of the outer conductor housing which has approximately the same inner diameter as the outer conductor of the cable, wherein the distance between the crimp point and the main body is approximately 0 mm.

11. The plug connector arrangement of claim 4, wherein the crimp has three or more flat pressing surfaces surrounding the inner conductor which each have substantially the same dimension in the circumferential direction, wherein the sleeve section preferably has, in cross section, a substantially square outer contour at the crimp point.

12. The plug connector arrangement of claim 5 wherein the outer diameter of the sleeve section at the crimp point is less than at the further crimp point.

13. The plug connector arrangement of claim 5, including a supporting sleeve surrounding the inner conductor on the side of the crimp point facing away from the plug connector.

14. The plug connector arrangement of claim 12, including a supporting sleeve surrounding the inner conductor on the side of the crimp point facing away from the plug connector.

15. The plug connector arrangement according to claim 13, wherein the supporting sleeve is arranged radially on the outside of the outer conductor, and wherein the outer conductor is folded back over the supporting sleeve.

16. The plug connector arrangement of claim 4, wherein the crimp point is in the form of a star crimp.

17. The plug connector arrangement of claim 4, wherein the crimp has four flat pressing surfaces surrounding the inner conductor which each have substantially the same dimension in the circumferential direction, wherein the sleeve section preferably has, in cross section, a substantially square outer contour at the crimp point.

18. The plug connector arrangement of claim 16, including at least one further crimp point on the side of the crimp point facing away from the plug connector at which the outer conductor of the cable is pressed together with the sleeve section of the plug connector. from the plug connector.

19. The plug connector arrangement of claim 6, wherein the outer conductor is in the form of a wire braid.

* * * * *